United States Patent [19]

Tarumi et al.

[11] Patent Number: 4,542,978

[45] Date of Patent: Sep. 24, 1985

[54] IMAGE REPRODUCING APPARATUS WITH HIGH-SPEED TRANSFER MECHANISM

[75] Inventors: Noriyoshi Tarumi, Hachioji; Kiyoshi Kimura, Iruma; Kouichi Gunji, Hachioji, all of Japan

[73] Assignee: Konsihiroku Photo Industry Co., Ltd., Tokyo, Japan

[21] Appl. No.: 578,305

[22] Filed: Feb. 9, 1984

Related U.S. Application Data

[63] Continuation of Ser. No. 478,808, Mar. 25, 1983, abandoned, which is a continuation of Ser. No. 283,812, Jul. 16, 1981, abandoned.

[30] Foreign Application Priority Data

Jul. 21, 1980 [JP] Japan ..... 55-98654

[51] Int. Cl.[4] ..... G03G 15/16; G03G 15/20

[52] U.S. Cl. ..... 355/3 TR; 355/3 FU

[58] Field of Search ..... 355/3 TR, 3 FU, 16, 355/3 R; 430/99, 124, 126

[56] References Cited

U.S. PATENT DOCUMENTS

| | | | |
|---|---|---|---|
| 3,591,276 | 7/1971 | Byrne | 355/3 TR |
| 3,893,761 | 7/1975 | Buchan et al. | 355/3 TR |
| 3,937,572 | 2/1976 | Gaynor et al. | 355/16 |
| 4,183,658 | 1/1980 | Winthaegen | 355/16 X |
| 4,195,927 | 4/1980 | Fotland et al. | 355/3 TR |
| 4,207,101 | 6/1980 | Vola et al. | 355/3 TR |

*Primary Examiner*—R. L. Moses

*Attorney, Agent, or Firm*—Jordan B. Bierman

[57] ABSTRACT

An image reproducing apparatus comprising a driven, toner image retaining member, an intermediate transfer belt, an intermediate transfer belt supporting mechanism including a cylindrical heating roller, and a pressure roller contacting via said intermediate transfer belt in a transfer position with the outer circumferential surface of said heating roller which is in an intermediate transfer belt removing point or a point in the vicinity thereof. The intermediate transfer belt moves in accordance with said toner image retaining member to allow the toner image to be transferred thereto when said intermediate transfer belt is brought into contact with the surface of said toner image retaining member. The intermediate transfer belt supporting mechanism contacts at its outer circumferential surface the rear surface of said intermediate transfer belt. The toner image on said intermediate transfer belt is transferred to a transfer sheet material in the second-mentioned transfer position. The intermediate transfer belt is wrapping more than semi-circle of said heating roller.

12 Claims, 4 Drawing Figures

IMAGE REPRODUCING APPARATUS WITH HIGH-SPEED TRANSFER MECHANISM

This application is a continuation of continuing application Ser. No. 478,808, filed Mar. 25, 1983, now abandoned, which is in turn a continuation of application Ser. No. 238,812 filed July 16, 1981, now abandoned.

BACKGROUND OF THE INVENTION

1. Field of the Invention

This invention relates to an image reproducing apparatus, such as is used in an electrophotographic copying machine.

2. Description of the Prior Art

In an image reproducing apparatus having an intermediate transfer member, a toner image on a toner image retaining member, formed by developing an electrostatic latent image with toner, is transferred to said intermediate transfer member, generally an endless belt, and is then again transferred and fixed to a transfer sheet material, such as transfer paper, forming a picture image thereon. When such an image reproducing apparatus is used, a final picture image of a high quality can be obtained. This apparatus permits use of a so-called retention system, in which an electrostatic latent image once formed can be utilized several times by subjecting said image to developing and transferring operations repeatedly to obtain a plurality of identical final picture images, allowing the reproduction of picture images to be easily carried out at an increased speed. In addition, even when a one-component conductive toner is used as a developer, a toner image can be transferred to an ordinary paper. Accordingly, a developing system can be simplified, and the quality of a picture image can be improved.

In order to transfer a toner image formed on an intermediate transfer member to a transfer sheet material, or transfer such a toner image to a transfer sheet material and fix the same thereto simultaneously, it is necessary in general that the toner image be heated before it is transferred to the transfer sheet material. In the meantime, it is also necessary to eliminate adverse effects of heat upon the parts and elements of the image reproducing apparatus. Therefore, it is desirable for the temperature of a toner image-retaining intermediate transfer member to be maintained at as low a level as possible, yet at the same time for it to be high enough to heat the toner sufficiently. If an image-retaining member is overheated, these adverse effects include a decrease in the electric potential of an electrostatic image, the fusion of toner, and difficulty in cleaning the toner image retaining member.

In an attempt to eliminate these inconveniences, various methods have been proposed, which include a non-contact heating method, in which the radiation heat is applied to the surface of an intermediate transfer member, and a method in which a heating element consisting of a pressure roller for pressing a transfer sheet material against the surface of an intermediate transfer member is used to heat the toner via the transfer sheet material. In addition to these methods, a method has also been developed in which the contact surface area between the transfer sheet material and the intermediate transfer member is increased to improve the transfer efficiency.

However, in order to heat the toner on the intermediate transfer members employed in the above-mentioned methods to a desired level, a large heat source is required. To use a large heat source in these methods would cause increased energy consumption and various troubles due to the large amounts of heat. Since a large heat source cannot be used in these methods, the speed of the intermediate transfer members in use, and thus the image reproduction speed, is limited. Consequently it can be said that the intermediate transfer members are utilized meaninglessly in the above-mentioned methods. Moreover, the condition of an image transferred to a transfer sheet material in these methods varies greatly with the thickness and weight of the transfer sheet materials in use.

SUMMARY OF THE INVENTION

An object of the present invention is to provide an image reproducing apparatus free from the above-mentioned drawbacks encountered in a conventional image reproducing apparatus of this kind, capable of heating the toner on an intermediate transfer member sufficiently with a small heat source to thereby effect the transfer of a toner image to a transfer sheet material in an excellent manner at all times, and also capable of moving the intermediate transfer member at high speed to allow picture images to be reproduced at a faster rate.

To this end, the present invention provides an image reproducing apparatus comprising a driven toner image retaining member, an intermediate transfer belt moving in accordance with the toner image retaining member to allow the toner image to be transferred thereto when the intermediate transfer belt is brought into contact with the surface of the toner image retaining member, an intermediate transfer belt supporting mechanism including a cylindrical heating roller which contacts at its outer circumferential surface the rear surface of the intermediate transfer belt, and a pressure roller contacting via the intermediate transfer belt in the intermediate transfer belt removing point of the outer circumferential surface of the heating roller, or a transfer position in the vicinity thereof, the toner image on the intermediate transfer belt being transferred to the transfer sheet material at this transfer position.

The above and other objects as well as advantageous features of the invention will become apparent from the following description of the preferred embodiments taken in conjunction with the accompanying drawings.

DESCRIPTION OF THE PREFERRED EMBODIMENTS

Figure 1:
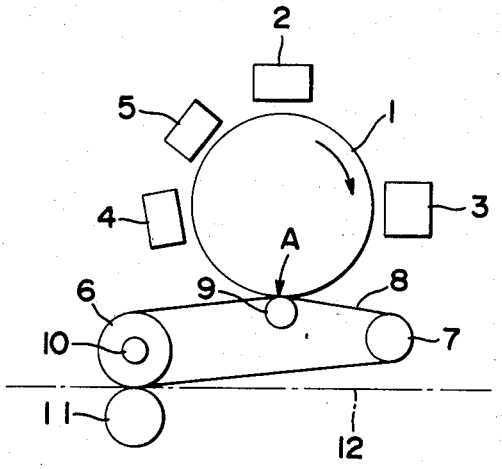
FIG. 1 is a schematic diagram illustrating the construction of the principal portion of an image reproducing apparatus embodying the present invention.

FIG. 1 shows the construction of a principal portion of an image reproducing apparatus using a retention system and having an intermediate transfer member. In this apparatus, an electrostatic latent image forming unit 2, a developing unit 3, a charge eliminating unit 4, and a cleaning unit 5 are arranged in that order along the outer circumferential surface of a drum type charge retaining member 1 (hereinafter called "retaining member") rotating in the direction of the arrow. If the retaining member 1 consists of a photoconductive material, the electrostatic latent image forming unit 2 is used a charge generator and an optical exposure system. If the retaining member 1 consists of a dielectric material, the electrostatic latent image forming unit 2 consists of multi-stylus electrodes or ion modulating electrodes. An electrostatic latent image formed by the image forming unit 2 is developed by the developing unit 3 into a toner image.

Figure 2:
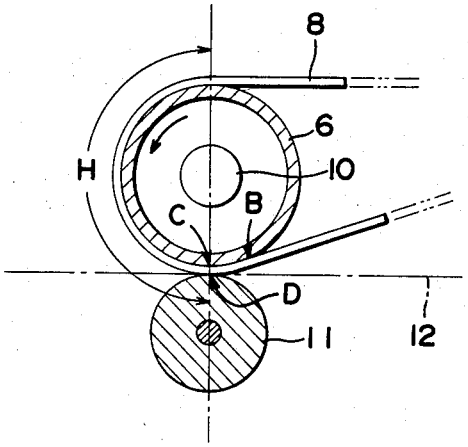
FIG. 2 is an enlarged sectional view of the heating roller and pressure roller shown in FIG. 1.

In apparatus according to the present invention, an endless rubber belt 8 (hereinafter called simply "belt") is supported on a roller system including a heating roller 6 and a tension roller 7. The outer surface of the belt 8 is brought by a transfer roller 9 into contact with the surface of the retaining member 1 in a first transfer position A in the region beyond the developing unit 3. As shown in FIG. 2, the heating roller 6 may consist of, for example, a cylindrical aluminum roller body and a heat source 10 composed of an infrared ray lamp provided therein. The belt 8 is wrapped around the heating roller 6 in such a manner that the rear surface of the belt is in surface contact with a heating region H of not less than 90° of the outer circumferential surface of the heating roller. A pressure roller 11 presses a transfer sheet material and the belt 8 against the heating roller 6 at a position B at which the belt 8 in motion is removed from the outer circumferential surface of the heating roller 6, or a position C which is spaced a little before the belt-removing point B. The transfer sheet material, such as transfer paper, is fed along a path 12 thereof which passes through the contact point between the pressure roller 11 and belt 8.

In the image reproducing apparatus according to the present invention having the above-described construction, a toner image on the retaining member 1 is transferred to the outer surface of the belt 8 in the first transfer position A, at which the belt 8 is pressed against the retaining member 1 by the transfer roller 9. The toner image transferred to the belt 8 is carried thereby toward the heating region H. While the belt 8 advances through the heating region H, the toner image is heated via the belt 8, so that the toner image is softened or fused. The toner image is then transferred again and fixed to the transfer sheet material, fed along the path 12 thereof, by the pressure force of the pressure roller 11 and heating roller 6 applied thereto at the second transfer position D in which the pressure roller 11 and belt 8 are opposed to each other. As a result, an objective picture image is reproduced.

According to the present invention, the heating roller 6 is formed cylindrically and adapted to enclose the heat source 10, so that substantially the whole of the heat from the heat source 10 is applied to the heating roller 6 with no part of the heat diffused out of the heating roller 6. Since the toner on the belt 8 is heated via the belt 8 by the heating roller 6 in contact with the rear surface thereof, the toner is heated with an extremely high efficiency. Moreover, when the heating region H, in which the belt 8 is in contact with the heating roller 6, is sufficiently long, the temperature of the belt 8 entering the heating region H is increased gradually, so that the temperature of the belt 8 becomes substantially equal to that of the heating roller 6 in the vicinity of the end of the heating region H. Accordingly, the toner is heated gradually, so that the temperature thereof is increased to a level near the softening point thereof, or a level a little higher than the softening point. Owing to such a long heating region H, the toner on the belt 8 is fused in the desired manner in the heating region H even when the temperature of the heating roller 6 is set at a low level near the softening point of the toner, so that the toner image is transferred and fixed to the transfer sheet material when the belt 8 is pressed against the transfer sheet material in the second transfer position D. Thus, it is unnecessary to set the temperature of the heating roller 6 to the high level required to heat the toner instantaneously to the softening point thereof. Specifically, the temperature of the heating roller 6 may be set to around 80°–150° C., near the softening point of the toner. Above-mentioned heating region H is preferable more than semicircle of the heating roller. Because the second transfer position D is provided at the end of the heating region H, or in the vicinity of the end, the heat from the heating roller 6 is not applied to an ineffective portion of the belt 8 which has passed the transfer position D. This minimizes the energy consumption.

In addition, when the temperature of the belt 8 entering the heating region H during a continuous copying operation is increased gradually, the temperatures of the belt 8 and toner in the second transfer position D can be controlled to a level which is substantially equal to the set temperature of the heating roller 6, owing to the sufficiently long heating region H. Accordingly, the toner to be transferred to a transfer sheet material will always be maintained in a predetermined fused condition so the transferring and fixing operations can be carried out stably at all times. Moreover, an offset phenomenon ascribed to the overheating of toner is prevented. Unlike an image reproducing apparatus that employs a instantaneous toner heating system, the image reproducing apparatus according to the present invention is free from a gradual increase in the temperature of that portion of the belt 8 which has just passed the second transfer position D. In other words, the apparatus according to the present invention permits the temperature of the belt 8 in the second transfer position D to be maintained at a constant level, which is a minimal level or a level in the vicinity thereof. Therefore, heat troubles having a direct relation to the temperature of the belt 8 can be prevented, and power loss can be minimized.

When the diameter of the heating roller 6 of the above-described construction is reduced to shorten the distance between the heat source 10 and the heating surface of the heating roller 6, the toner on the belt 8 can be heated more effectively. This advantageous effect based on the reduction of the diameter of the heating roller 6 gives a sufficient compensation for the disadvantages from decreasing the length of the heating region H by reducing the diameter of the heating roller 6, if the reduction of the diameter of the heating roller 6 is carried out within a predetermined range. This allows the image reproducing apparatus to be miniaturized to a great extent. Since the toner on the belt 8 in the apparatus according to the present invention is heated by the heating roller 6 at an extremely high efficiency as previously mentioned, the feed rate of the belt 8 can be increased as compared with the feed rate of a similar toner image retaining member in an apparatus of this kind in the prior art employing a heat source with substantially the same energy consumption as the heat source 10 employed in the apparatus according to the present invention, to greatly improve the reproduction speed of picture images.

The following are examples of numerical values regarding the apparatus according to the present invention.

In a case where ordinary toner having a softening point of 90°–150° C. is used, it is preferable that the heating roller 6 has an outer diameter of 20–70 mm and a surface temperature of 100°–200° C., and that the belt 8, provided with a superficial layer consisting of silicone rubber, has a thickness of 30–300μ and a feed rate of 50–700 mm/sec.

A preferable relation of the above can be expressed by a following formula.

$$\theta = a \cdot V/R \cdot (c \cdot r)/k \cdot d^2$$

where d represents the thickness (cm) of the intermediate transfer belt V represents the moving speed (cm/sec) of said belt, R represents the radius of the heating roller, k represents the mean thermal conductivity (cal/cm·sec·degree) of said belt, r represents the mean specific gravity (cal/g·degree) of said belt, $\theta$ represents an angle (radian) through which the heating roller is wrapped by said belt, c represents the specific heat of the belt, and a is a positive integer determined by the design condition of the apparatus such as the diameter of the heating roller etc., preferably the positive integer within 1–10, most preferably 4–10.

Figure 3:
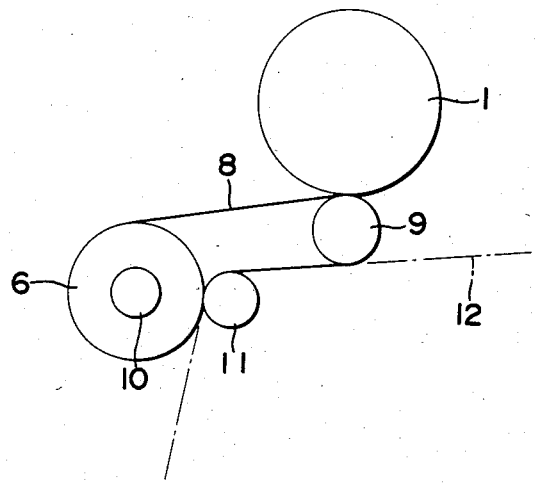
FIG. 3 is another example of an intermediate transfer member supporting mechanism employing the present invention.
Figure 4:
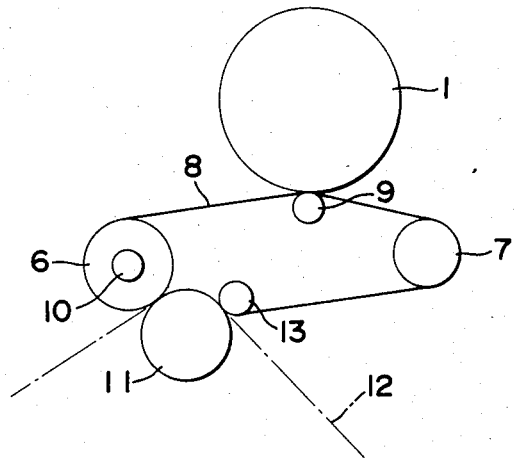
FIG. 4 is still another example of an intermediate transfer member supporting mechanism employing the present invention.

The above is a description of an embodiment of the present invention. The mechanism for supporting the belt 8 can be modified in various ways. In a modification of this mechanism shown in FIG. 3, the heating region H has an angle $\theta$ as large as 250°. In another modification shown in FIG. 4, a long heating region H is provided, and an auxiliary roller 13 is utilized to control the direction a transfer sheet material is discharged.

As described in detail above, the image reproducing apparatus according to the present invention has an extremely simple construction and permits transferring a toner image supported on an intermediate transfer belt to a transfer sheet material in an excellent manner at all times using a small heat source; increasing the feed rate of the intermediate transfer member to a great extent; and miniaturizing the image transfer system with respect to the transfer sheet material.

The present invention is not, of course, limited to the above embodiments; it may be modified in various ways within the scope of the appended claims.

What is claimed is:

1. An image reproducing apparatus comprising a driven toner image retaining member, an endless transfer belt moving with said toner image retaining member to allow the toner image to be transferred thereto when said transfer belt is brought into contact with the surface of said toner image retaining member, means pressing said belt into contact with said image retaining member, a belt supporting mechanism including a cylindrical roller about whose outer surface the inner surface of said transfer belt is wrapped through an angle of contact $\theta$, determined by the following formula:

$$\theta = a \times V/R \times (C \times r)/k \times d^2$$

wherein:

a is a positive integer

V is the moving speed of the belt in cm/sec.

R is the radius of the cylindrical roller in cm.

C is the specific heat of the belt in calories/gram °C.

r is the mean specific gravity of the belt k is the thermal conductivity of the belt in calories/cm sec.

d is the thickness of the belt in cm., transfer sheet material, a pressure roller first urging said transfer sheet material against said transfer belt approximately adjacent the point where the belt departs the outer surface of said cylindrical roller, and means heating said cylindrical roller to a temperature at which the surface of said belt is substantially equal to the softening point of the toner at said point, whereby the toner image on said transfer belt is gradually heated by said cylindrical roller throughout said angle of contact and is transferred to the transfer sheet material fed between said pressure roller and said belt.

2. An image reproducing apparatus according to claim 1, wherein said a has a value within the range 1–10.

3. An image reproducing apparatus according to claim 2, wherein said a has a value within the range 4–10.

4. An image reproducing apparatus according to claim 2, in combination with a heat source positioned within said cylindrical heating roller.

5. An image reproducing apparatus according to claim 4, wherein said heat source is an infrared ray lamp.

6. An image reproducing apparatus according to claim 1, wherein said intermediate transfer belt has a thickness of 30–300μ.

7. An image reproducing apparatus according to claim 1, wherein said intermediate transfer belt has a feed rate of 50–700 mm/sec.

8. An image reproducing apparatus according to claim 7, wherein said intermediate transfer belt has a thickness of 30–300μ.

9. In an image reproducing apparatus of the type in which a toner image on a rotatable image retaining member is first transferred to an endless belt at one position of the belt and then retransferred from said belt to a sheet at another position of the belt, the improvement comprising a cylindrical roller supporting said belt at said retransfer position, a pressure roller first urging said sheet against said transfer belt approximately adjacent the point where the belt departs from the outer peripheral surface of said cylindrical roller, and means heating said cylindrical roller to a temperature at which the image carrying surface of said belt is substantially equal to the softening point of the toner at the point of contact between said sheet and said belt.

10. The improved image reproducing apparatus according to claim 9, wherein said belt is in contact with the cylindrical roller through not less than 180 degrees of the outer circumferential surface of the cylindrical roller.

11. The improved image reproducing apparatus according to claim 9, wherein a heat source is installed in said cylindrical roller.

12. The improved image reproducing apparatus according to claim 11, wherein said heat source is composed of an infrared ray lamp.

* * * * *